United States Patent [19]

Loveland

[11] 3,990,487

[45] Nov. 9, 1976

[54] VACUUM FILLER

[75] Inventor: Malcolm W. Loveland, Orinda, Calif.

[73] Assignee: Atlas Pacific Engineering Company, Emeryville, Calif.

[22] Filed: Apr. 9, 1975

[21] Appl. No.: 566,241

[52] U.S. Cl. ..... 141/61; 141/305

[51] Int. Cl.[2] ..... B65B 31/00

[58] Field of Search ..... 141/4, 5, 7, 8, 47–49, 141/54–57, 59, 61, 65, 82, 286, 301, 302, 305

[56] References Cited

UNITED STATES PATENTS

| | | | |
|---|---|---|---|
| 2,543,788 | 3/1951 | Loveland | 141/305 X |
| 2,903,023 | 9/1959 | Battinich | 141/305 X |

*Primary Examiner*—Richard E. Aegerter
*Assistant Examiner*—Frederick R. Schmidt

[57] ABSTRACT

A vacuum filler is provided which enables empty or partially full cans to be filled without drawing a significant amount of the filling material into the vacuum system.

1 Claim, 12 Drawing Figures

VACUUM FILLER

BACKGROUND OF THE INVENTION

Typical vacuum filling devices are shown in my prior U.S. Pat. No. 2,543,788 and in the Battinich U.S. Pat. No. 2,903,023.

The filling cycle in the Battinich device includes drawing of a vacuum in the can and then admitting the filling material to the can through the same passageway to dissipate the vacuum in the can. Some of the filling material is left clinging to the filling passage side wall with the result that this material is swept out of that passageway with the violent withdrawal of air upon vacuum application to the next can to be filled. This is repeated with each can filled. In the case of a heavy product such as a puree, this amounts to as much as an ounce per can and, with a thick syrup, as much as a half ounce would be involved. This is a disadvantage when it is deemed unsanitary to return such material to the filler bowl because this requires either discharge of the filling material or its reprocessing.

The Battinich filler is not suited to filling an empty can because of the practical consideration that the vacuum available in canneries does not normally exceed 27 inches as a maximum and may be even less. Under a 27 inch vacuum, approximately a tenth of the original can air volume remains to form a large bubble in the filled can when the vacuum is dissipated. Thus, if the can is 4.5 inches high, an air bubble of 0.45 inches in height will be present whereas the can should be filled to within about 0.25 or 0.30 inches from the top.

If one attempts to modify the Battinich filling head to provide accommodation for the large air bubble, the result is to have the fill level fluctuate greatly with the not uncommon fluctuations in the vacuum applied. For example, lowering of the vacuum to 26 inches occasionally in the vacuum system is not uncommon in a system which normally operates at 27 inches, but a 26 inch vacuum would produce a bubble 0.60 inches high in a 4.5 inch can. This increase of 0.15 inches would be intolerable in a commercial can filling operation.

In U.S. Pat. No. 2,543,788 the filling device had separate fill and vacuum passages. Some of the filling material is retained in the filling head where it would be exposed to the vacuum as it was drawn into the can.

SUMMARY OF THE INVENTION

The can filling device of the present invention is particularly suited to the filling of empty cans with a hot product. This is the common method of canning juices and puree because the material to be canned is generally sterile from its heating and it carries sufficient heat to sterilize the can by holding the canned product for a few minutes at the filling temperature.

In the can filling device of this invention, the filling port shape has been arranged to remain full of the fill material from can to can. The first cans of a run are dumped because they are slack filled but the succeeding cans are filled full because, as the vacuum rises in the can to about 15 inches with a 180° F. filling temperature, the material trapped in the filling port flashes and the steam so formed explodes the material into the can as the vacuum is being drawn. In the can, more of the material flashes into steam and sweeps the air from the can. A few drops of liquid converted into steam is sufficient to sweep the air from the can. At 180° F. the expansion ratio is about 3000 to 1. Other filling temperatures produce similar large expansions.

Upon entry of the hot fluid during filling, the vacuum reaches a level consistent with the fill material flash point (15 inches at 180° F.) and persists at that level until the fill is complete. As the vacuuum tries to drop below the flash point because of the entry of fill material, some steam condenses and effectively maintains the fill vacuum differential until the can is completely full up to the displacement pad and all the steam is fully condensed. Theoretically, there is no air bubble present but practically there may be a very small bubble because of the incomplete evacuation of the air by the steam. At the end of the fill cycle the valve shifts to vent the can to the atmosphere through the central port so the can may be removed without suction.

The opening into the can for the filling liquid is provided in the form of one or more slots having about a 1/16 inch maximum width. This retains the filling material by surface tension since the other end of the passage is closed by the valve.

The filling of the empty cans by flashing the hot product to eliminate all or nearly all of the air from the can has a double effect:

1. It makes filling a true solid displacement cycle where the fill is controlled by a diplacement pad.
2. It gives a very fast complete fill even with thick products.

To illustrate a further advantage of the present device in handling a thick product, if one assumes that it takes a pressure differential of about 2 inches of vacuum to cause a product like a puree to flow, then on a typical prior art vacuum filler, the filling action would cease when the can vacuum fell to 2 inches and would be very slow as it approached 2 inches. In the cycle of the present vacuum filler, there is no air or very little air to be compressed at the end of the fill to cause the vacuum to drop to 2 inches as the fill proceeds. The result is that the fill proceeds at full vacuum commensurate with the temperature until the last steam bubble collapses with the can completely full. In the case of a fill at 180° F., the vacuum persists at about 15 inches to the end of the fill instead of slowing down to zero at about 2 inches of vacuum.

In general it is the broad object of the present invention to provide an improved vacuum filling device, particularly one enabling empty cans to be filled.

A further object of the filling device of the present invention is that drawing of a significant amount of the filling fluid into the vacuum system is avoided.

DESCRIPTION OF THE PREFERRED EMBODIMENT

Figure 1:
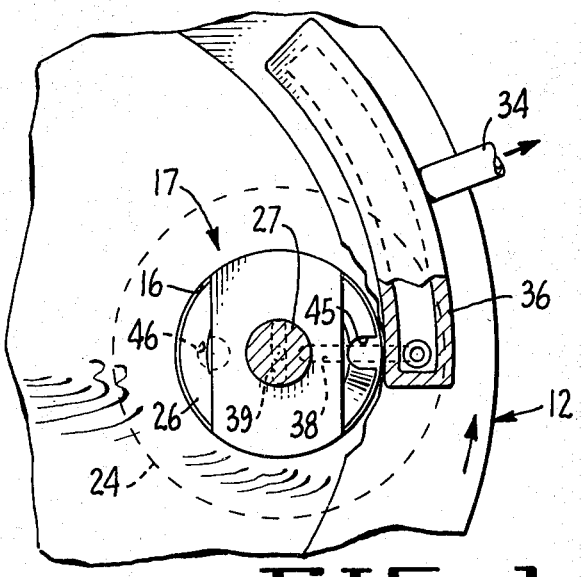
FIG. 1 is a fragmentary plan view of the syrup bowl showing the relation of the bowl relative to the valve mechanism.
Figure 2:
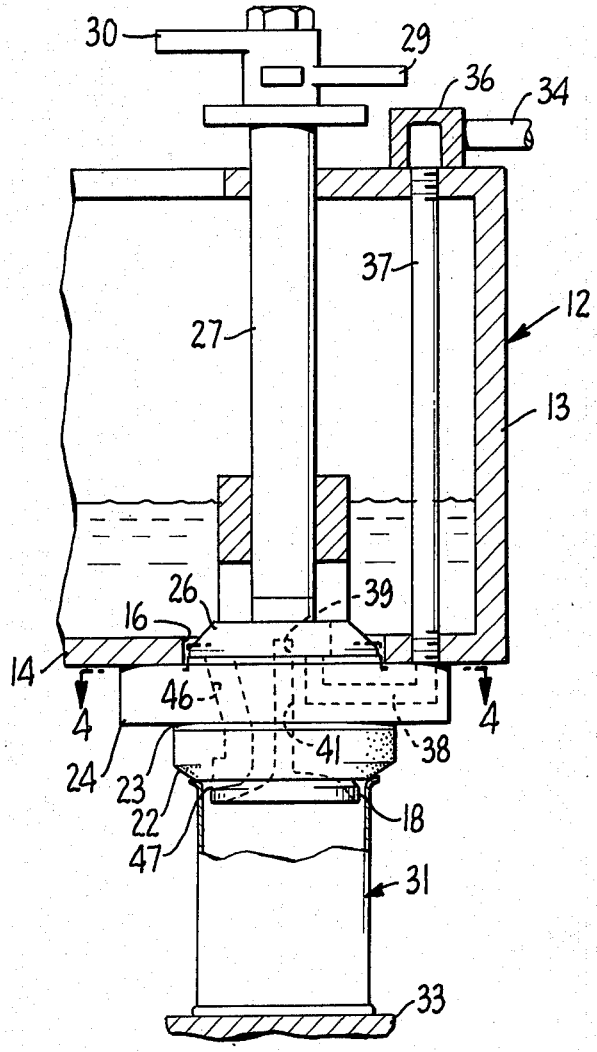
FIG. 2 is an elevational section through the bowl and valve showing a can in filling position.

Referring to FIGS. 1 and 2 in the drawings, in broad terms the apparatus and method of the present invention comprises the attachment of a valve to the bottom of a receptacle or bowl, bringing a can to be filled subjacent said bowl and in alignment with the valve, then turn the valve to produce a partial vacuum in the can to largely evacuate the air therefrom, turning the valve to place the interior of the can in communication with the bowl whereby a combination of liquid head and pressure differential causes the liquid to flow rapidly from the bowl into the container, and then turning the valve to vent the can to the atmosphere so as to break the suction seal between the can and valve. Such an arrangement will fill products which entrap air such as fruit halves and ensure the proper maintenance of liquid height in each can.

Referring now more specifically to the structure diclosed in the drawings, the valve of the present invention is adapted to be operatively installed on a receptacle or filler bowl, generally indicated by the numeral 12, and including a side wall 13 and a bottom wall 14. The bowl bottom 14 is provided with an opening 16 in which the valve 17 of the present invention is operatively inserted this valve is sometimes referred to hereinafter as the bottom valve. As is common with this type of filling arrangement, the bowl as well as the valve mounted thereon, rotate about a central vertical axis, and cans are fed underneath the bowl and in axial alignment with the respective valves so that during the approximate 300° of rotation during which they are in contact with the valve, the valve will pass through its cycle and the liquid from the bowl 12 will flow into the can. When the valve is closed, the can is then separated and discharged from beneath the bowl. Also, as is well-known in the art, the primary engagement and separation of the can from the valve is effected by providing a lift for each can as it approaches the bowl which forces the same into engagement with the filling valve and then is caused to descend to effect a separation thereof. As this arrangement is well-known in the art, no detailed description is deemed necessary of such arrangement for an understanding of the present invention.

Figure 3:
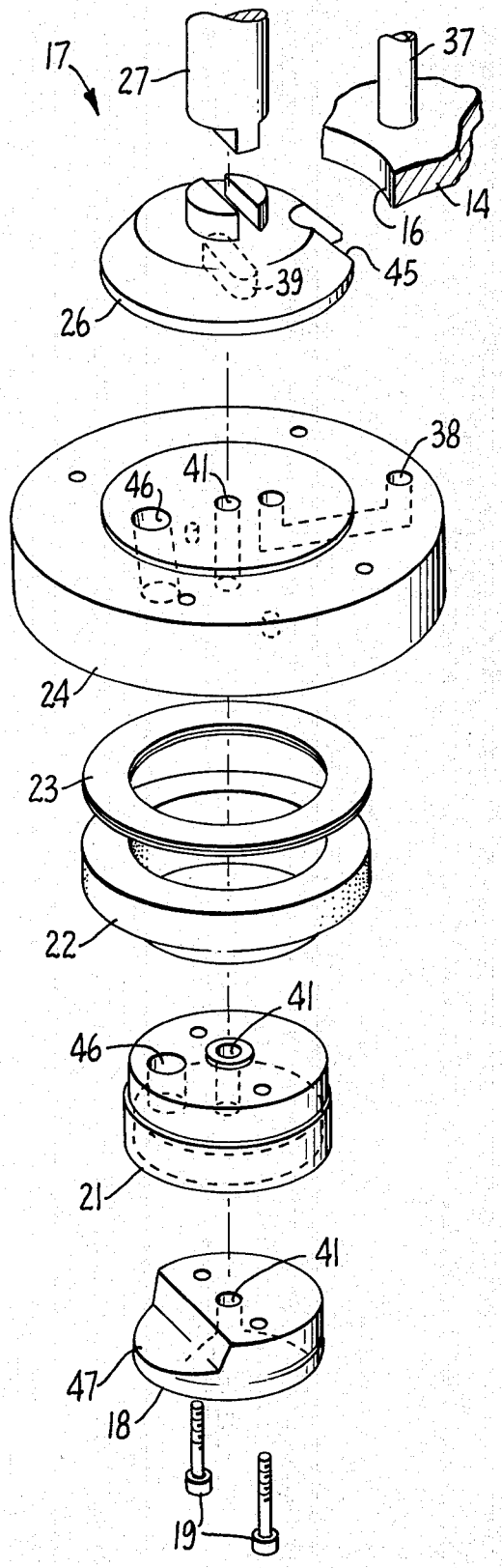
FIG. 3 is an exploded view of the valve mechanism showing its several parts.

The valve 17 includes the several elements which appear in the exploded view designated as FIG. 3. This includes the displacement pad 18 secured by screws 19 to a holder 21. The holder 21, in turn, receives the rubber ring 22 which has spacing washers 23 on its upper surface. The valve seat 24 is mounted, in turn, on bottom wall 14 in the opening 16 and supports holder 21. Superimposed on the valve seat 24 is a valve plate 26. Mounted upon a central shaft 27 are shown two of the four points, 29 and 30, of a four point star which turn the valve through four different positions as these appear in FIGS. 4 and 5, 6 and 7, 9 and 10, and 11 and 12.

Figure 4:
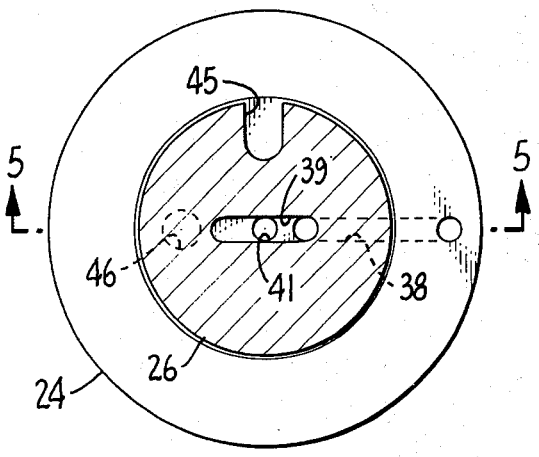
FIG. 4 is a section taken along the line 4—4 in FIG. 2 showing the valve mechanism in position for application of the vacuum.
Figure 5:
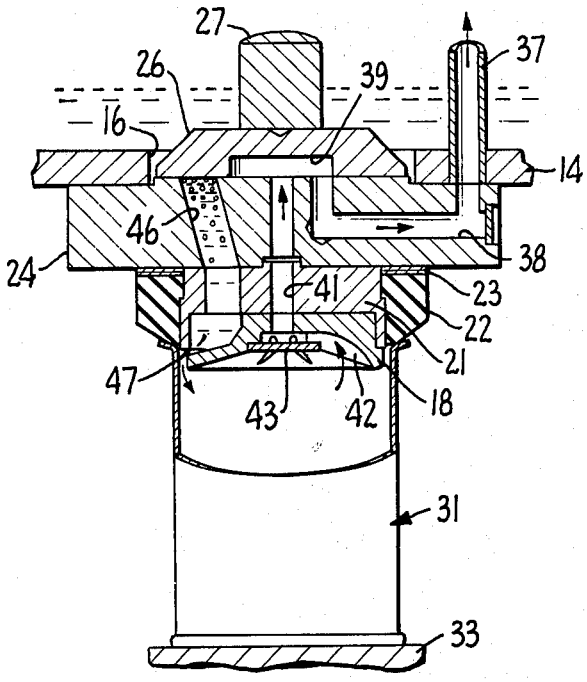
FIG. 5 is a cross-sectional elevation of the portion of the bowl and valve mechanism, the latter being in the position shown in FIG. 4 and taken along the line 5—5 of FIG. 4.
Figure 8:
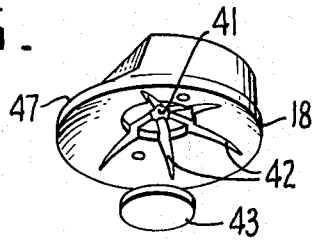
FIG. 8 is a bottom perspective view of the displacement pad of the filling head.

In the first position of the bottom valve as is shown in FIGS. 1 and 2, can 31 is shown in engagement with flexible seating element formed by rubber ring 22, the can being held in such engagement by a lift mechanism, generally designated as 33. In this position, the valve is ready to be turned to the vacuum position wherein vacuum is applied to the can from a vacuum source (not shown) connected to a pipe 34 which is attached to the chambered shoe 36 which rides over the top of the bowl 12. A pipe 37 is attached to the top and bottom of the bowl and extends downwardly to the valve seat 24. FIGS. 4 and 5 show the valve turned to the vacuum position. The valve seat 24 includes passage 38 which is in communication with passage 39 of the valve plate 26. Vacuum is applied to the can through passage 41 which extends through valve seat 24, holder 21 and displacement pad 18. The underside of the displacement pad includes a plurality of slots 42 which extend outwardly on the underside of the displacement pad as appears in FIG. 8. A baffle plate 43 is positioned over passage 41 to prevent any solid material in the can being filled from passing upwardly into passage 41 thereby plugging it.

Figure 6:
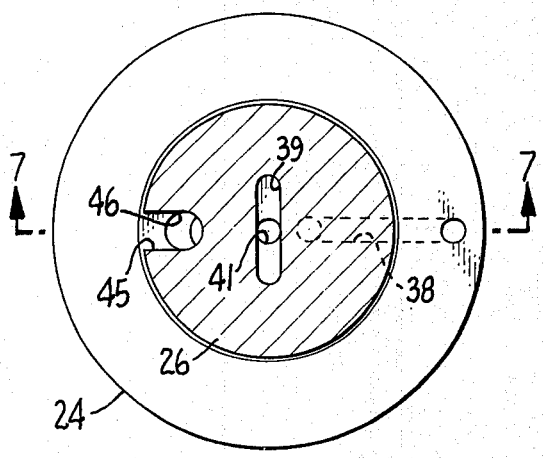
FIG. 6 is a cross section showing the valve moved 90° to a position in which the liquid in the bowl can flow into the can.
Figure 7:
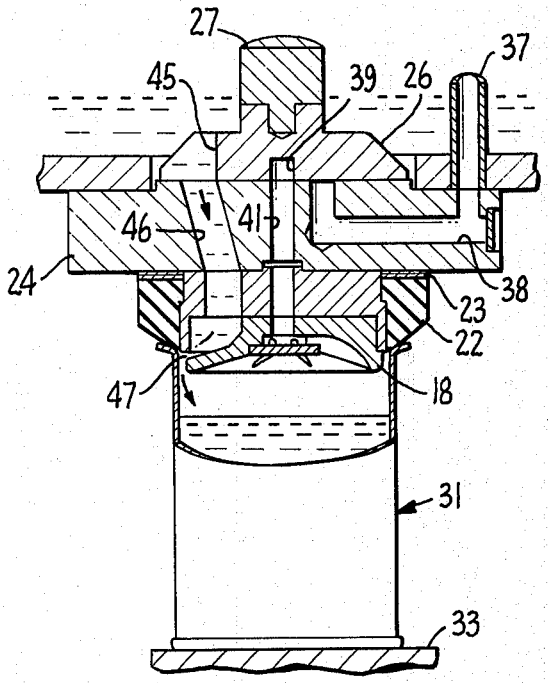
FIG. 7 is a cross-sectional elevation along the line 7—7 of FIG. 6.

After the vacuum application, the valve plate 26 is further indexed counterclockwise from the position shown in FIGS. 4 and 5 to the filling position shown in FIGS. 6 and 7. In this position, the valve plate 26 is turned to permit filling material to pass from the bowl through valve port 45 into passage 46 and over lip 47 into the can. Passage 39 is also moved from communication with passage 38 to isolate the vacuumized can from pipe 37. The application of vacuum is discontinued as the upper end of pipe 37 is moved away from the chambered shoe 36. Filling of the can then proceeds as has been previously outlined.

Figure 9:
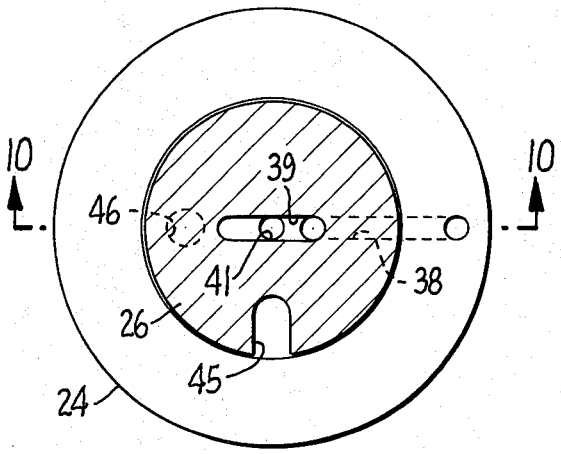
FIG. 9 is a view similar to FIGS. 4 and 6 but showing the valve in the venting position.
Figure 10:
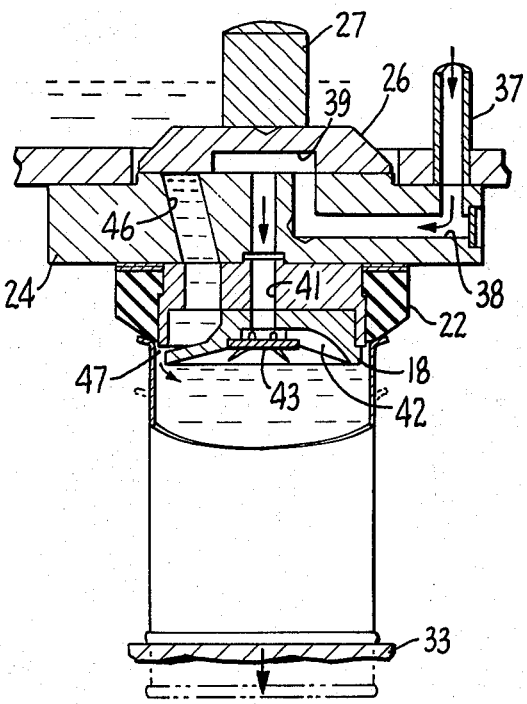
FIG. 10 is a cross-sectional elevation taken along the line 10—10 of FIG. 9.

The valve plate 26 is then rotated counterclockwise through an additional 90° to the position shown in FIGS. 9 and 10 in which air is admitted from the atmosphere through pipe 37.

As has been previously mentioned, the filling passage 46 remains filled wth material as appears in FIG. 10. The lifting mechanism 33 is lowered so the can is moved out of contact with the member 22 as in FIGS. 9 and 10.

Figure 11:
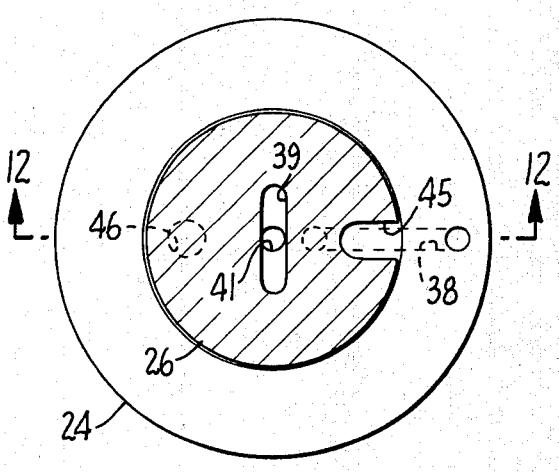
FIG. 11 is a cross-sectional view showing the valve in the "off" position in which the next can approaches the head.
Figure 12:
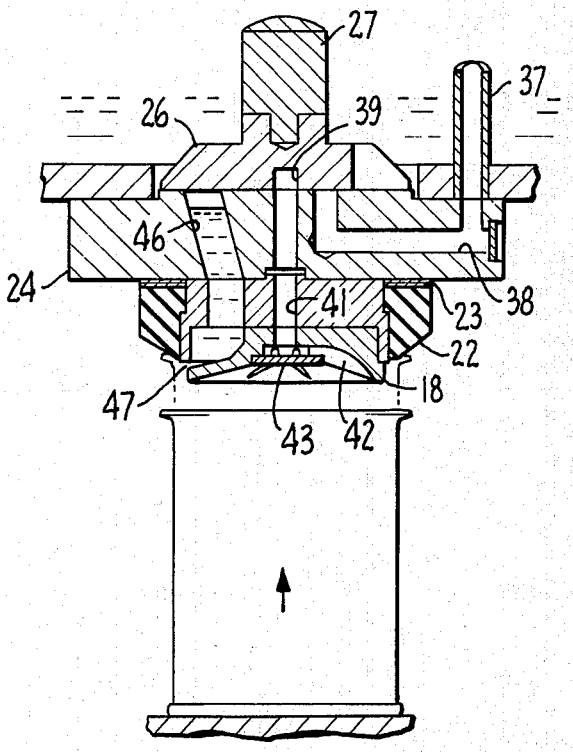
FIG. 12 is a cross-sectional elevation taken along the line 12—12 of FIG. 11.

The valve plate 26 is then rotated 90° to the position shown in FIGS. 11 and 12 which positions the valve plate to close off passages 41 and 46 in readiness for the next can. As mentioned earlier, the passage 46 between lip 47 and the bottom of valve plate 26 will remain full of the filling liquid. It is this liquid which will be flash vaporized and ejected into the next can when the can is vacuumized at the start of the next cycle and if the filling liquid temperature is at or above the boiling point consistent with the vacuum to be drawn.

I claim:

1. In a vacuum filler for containers, the filler having a bowl to contain the filling liquid and mounted for rotation, a bottom valve attached to the underside of the bowl at a radius from the axis of rotation, a filling head having a container seal and a displacement pad attached to the underside of the bottom valve, said bottom valve having a first through passage near its circumference leading into a liquid retention passage in the displacement pad, said first passage being in communication with the interior of a container in sealed engagement with said filling head, a second central passage through the said bottom valve and displacement pad also in communication with the interior of said sealed container, a third passage extending from the upper face of the bottom valve into a radial passageway substantially midway between the upper and lower faces of said valve and leading to a source of vacuum or to the atmosphere, said third passage being located radially between the first and second passage, a valve plate in rotatable sealed contact with the upper surface of the bottom valve and submerged in the liquid in the bowl, said valve plate having a diametrical groove in its contact face of a length to overlap said third passage but not the first passage during rotation of the valve plate to place the central second passage and the container in communication with the source of vacuum or atmosphere upon being so placed, a fourth passage through the valve plate radially located to overlap only the first passage through the bottom valve thus communicating the liquid in the bowl with the interior of the container, means to index the valve plate to communicate the passages in these successive steps:

a. passages two and three to apply vacuum to a container, b. passages one and four to fill the container with liquid and dissipate the vacuum, c. passages two and three to vent the container to the atmosphere so that it can be withdrawn from the filling head without suction, d. an off position wherein no passages are connected and the valve is in a position to repeat the series, and means to change the communication of passage three with the vacuum source or to the atmosphere as the bowl is rotated about its axis by its rotative means.

* * * * *